US005566527A

United States Patent [19]

Drewitz

[11] Patent Number: 5,566,527

[45] Date of Patent: Oct. 22, 1996

[54] APPARATUS FOR APPLYING A HEAT-SHRINKABLE BAND TO THE NECK OF A CONTAINER

[75] Inventor: Hugues Drewitz, St. Eustahe, Canada

[73] Assignee: H.G. Kalish, Inc., Quebec, Canada

[21] Appl. No.: 447,352

[22] Filed: May 23, 1995

[51] Int. Cl.[6] ..... B65B 7/28

[52] U.S. Cl. ..... 53/295; 53/296; 53/585

[58] Field of Search ..... 53/295, 296, 297, 53/298, 557, 329.2, 137.2, 585, 291; 83/54, 663

[56] References Cited

U.S. PATENT DOCUMENTS

| | | | |
|---|---|---|---|
| 1,806,475 | 11/1928 | Lee | 53/297 |
| 3,711,961 | 1/1973 | Spiegel et al. . | |
| 3,808,702 | 5/1974 | Laessig . | |
| 3,861,118 | 1/1975 | Muto . | |
| 3,910,013 | 10/1975 | Babineau | 53/291 |
| 3,959,065 | 5/1976 | Ashcroft . | |
| 4,059,400 | 11/1977 | Heckman et al. . | |
| 4,066,866 | 1/1978 | Fresnel . | |
| 4,092,382 | 5/1978 | Heckman et al. . | |
| 4,118,916 | 10/1978 | Fresnel . | |
| 4,179,863 | 12/1979 | Fresnel . | |
| 4,401,207 | 8/1983 | Garvey . | |
| 4,765,121 | 8/1988 | Kowstantin et al. | 53/585 |
| 5,001,887 | 3/1991 | Eder et al. . | |
| 5,417,041 | 5/1995 | Hansen et al. | 53/557 |

FOREIGN PATENT DOCUMENTS

| | | |
|---|---|---|
| 1123366 | 5/1982 | Canada . |
| 2332179 | 6/1977 | France . |
| 2369970 | 6/1978 | France . |
| 2490590 | 3/1982 | France . |
| 2536736 | 6/1984 | France . |

OTHER PUBLICATIONS

Shrink Sleeve Equipment, Van Dam Intersleeve, 4 pages.

*Primary Examiner*—John Sipos
*Assistant Examiner*—John Paradiso
*Attorney, Agent, or Firm*—Klarquist Sparkman Campbell Leigh & Whinston, LLP

[57] ABSTRACT

The invention relates to an apparatus for applying a heat-shrinkable band to the neck or to the body of a container. The apparatus comprises a feeding assembly for advancing a continuous sleeve of heat-shrinkable polymeric material along a predetermined path to slip the sleeve over the cap of the container. A cutting assembly then severs the sleeve to leave on the container cap a short band which can be heat-shrunk to form the tamper-proof seal. The cutting arrangement includes a blade carrier rotatable about the feed axis of the sleeve. An extendable cutting blade is mounted to the blade carrier. When the blade is extended to the cutting position, it pierces the sleeve. By rotating the blade carrier, the cutting blade is caused to slit the sleeve circumferentially until a complete cut is effected. The advantage of this arrangement is reduced blade wear, higher speed and possibility to apply the sleeve without any gating or timing of the containers.

11 Claims, 6 Drawing Sheets

APPARATUS FOR APPLYING A HEAT-SHRINKABLE BAND TO THE NECK OF A CONTAINER

FIELD OF THE INVENTION

This invention relates to an apparatus for applying a sleeve of polymeric material over a container, more particularly, it relates to an improved rotary cutting assembly for severing a dispensed length of the sleeve of polymeric material.

BACKGROUND OF THE INVENTION

Nowadays, it is common practice to apply a sleeve of polymeric heat-shrinkable material over the cap of a container holding ingestible substances such as medication or edible products, to form a tamper-proof seal. The sleeve of polymeric material is typically applied to the individual containers as a post filling and capping operation at an automated station which slips a measured length of heat-shrinkable tubing over each container and cuts the dispensed length which remains over the container cap. A jet of hot air is then directed at the container to cause the polymeric material to shrink and thus form a seal.

The sleeve applicator stations that are currently used by the industry employ a guillotine type cutting arrangement in which a blade is displaced at high speed across the sleeve feed axis to sever the material in a single stroke. This cutting arrangement, however, suffers from premature blade wear. More specifically, the high stress generated at the blade tip during the cutting impact with the sleeve cause significant material erosion which can dull the blade prematurely. Thus, the blade needs to be replaced frequently in order to prevent sleeve miss-cuts.

OBJECT AND STATEMENT OF THE INVENTION

An object of the invention is to provide an improved apparatus to apply a sleeve of polymeric material to a container which substantially avoids the premature blade wear associated with prior art devices.

As embodied and broadly described herein, the invention provides an apparatus for applying a sleeve of polymeric material to a container, the apparatus comprising:

(a) means for advancing the sleeve along a predetermined feed path for causing the sleeve to slip at least partially over the container;

(b) a sleeve cutting assembly, including:

a blade carrier rotatable about said feed path;

a cutting blade mounted to said blade carrier, said cutting blade being selectively moveable between a cutting position and a non-cutting position, in said cutting position said blade penetrating the sleeve, whereby rotation of said blade carrier causes said blade to slit the sleeve of polymeric material, in said non-cutting position said blade being in a spaced apart relationship with the sleeve thereby allowing the sleeve to advance along said feed path without interfering with said cutting blade.

In a most preferred embodiment, the cutting blade is displaced toward the cutting position by a blade actuator capable of reciprocating movement along the feed path of the sleeve. The blade actuator is a disk providing an annular race which is engaged by a mechanical lever mounted to the blade carrier that extends the cutting blade toward the cutting position when depressed. Thus, a displacement of the blade actuator toward the blade carrier causes the race to engage and depress the mechanical lever for, in turn, extending the blade and piercing the sleeve. The rotation of the blade carrier causes the extended cutting blade to slit the sleeve material. During this rotary movement the mechanical lever rides on the race of the blade actuator and thus remains depressed to maintain the cutting action.

When the sleeve has been cut, the blade actuator is retracted which causes the mechanical lever to return to its original non-cutting position, thus allowing the blade to retract. Advantageously, the blade retraction is achieved under the effect of centrifugal force caused by the rotating blade carrier.

When the blade carrier includes a single cutting blade a cutting cycle necessitates a full revolution to slit the sleeve material completely over its circumference. In a possible variant, the blade carrier may be provided with a plurality of equidistant cutting blades, say two diametrally opposed blades, in which case only a partial turn of the blade carrier is sufficient to completely sever the sleeve.

In a most preferred embodiment, however, a single blade is used which is continuously rotated about the sleeve feed axis. This arrangement brings about two advantages. First, there is no necessity to provide timing circuits to initiate and interrupt the blade revolution in accordance with the sleeve feed cycles. Second, the centrifugal force that continuously acts on the blade provides a very convenient way of retracting the blade.

As embodied and broadly described herein, the invention also provides an apparatus for applying a sleeve of shrinkable polymeric material over a container, said apparatus comprising:

a) feed means for advancing the sleeve of shrinkable polymeric material along a feed path for causing the sleeve to slip over a container;

b) a blade Carrier member rotatable about said feed path, said blade carrier including a central bore through which the sleeve of shrinkable material can pass;

c) a cutting blade mounted to said blade carrier, said cutting blade is moveable between an extended position and a retracted position, in said extended position said cutting blade engaging the sleeve of polymeric material, in said retracted position said cutting blade being in a spaced apart relationship with said sleeve of shrinkable polymeric material, whereby allowing the sleeve of shrinkable polymeric material to advance through said blade carrier without interfering with said cutting blade; and d) a blade actuating member mounted to said blade carrier, said actuating member being coupled to said cutting blade for moving said cutting blade toward said extended position in response to movement imparted to said blade actuating member.

DESCRIPTION OF THE PREFERRED EMBODIMENT

Figure 1:
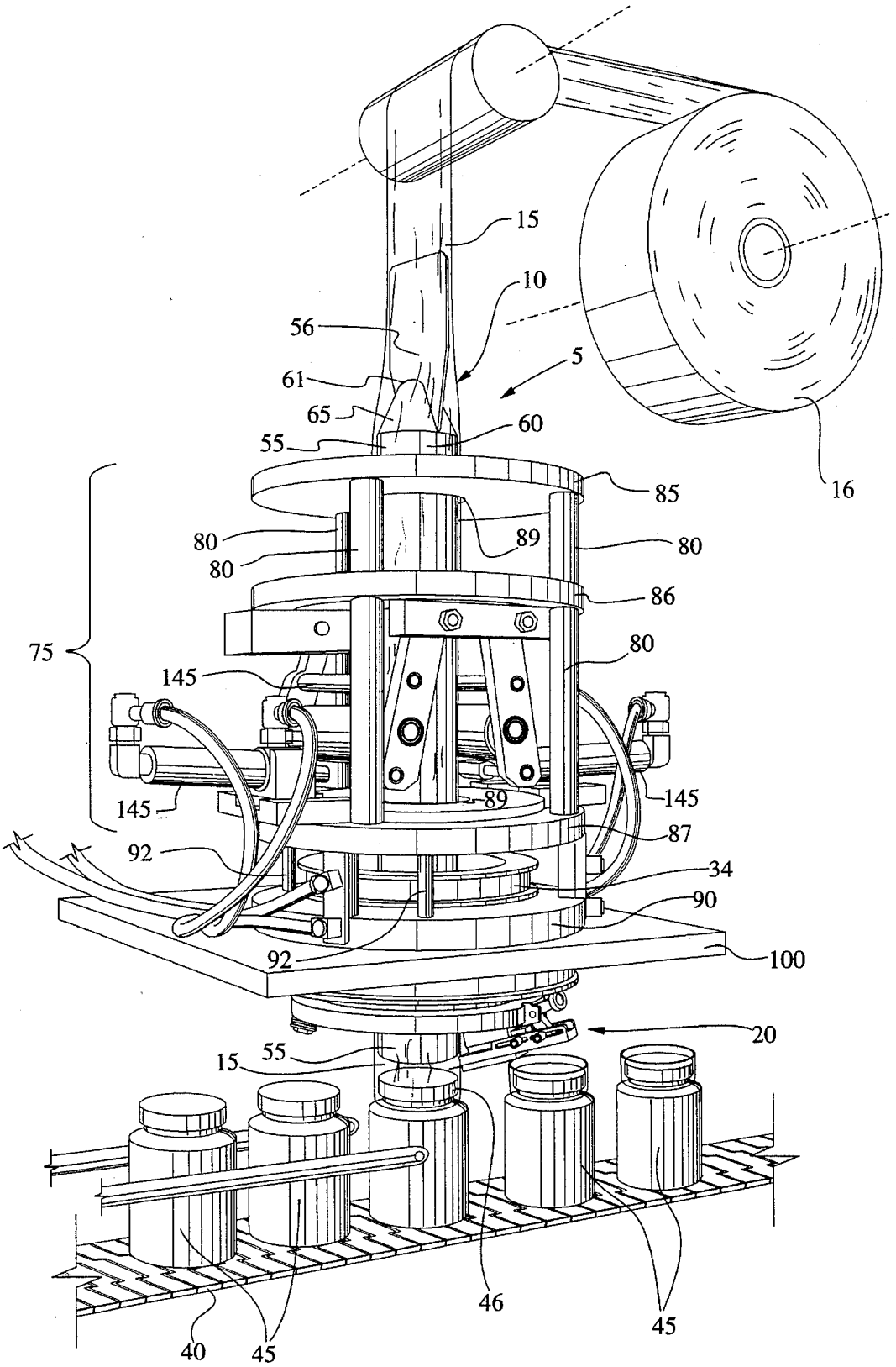
FIG. 1 is a perspective view of the apparatus in accordance with the present invention.

FIG. 1 of the annexed drawings illustrates an apparatus for applying a band of heat-shrinkable material over individual containers that are transported on a conveyor belt. The apparatus designated comprehensively by the reference numeral 5 includes two principal units, namely a feeding assembly 10 for advancing a sleeve 15 of heat-shrinkable material and a cutting assembly 20 for severing the sleeve.

In a typical set-up the apparatus 5 is usually part of container filling and packaging line that includes a container filling station and a container capping station. The apparatus 5, normally located near the end of the packaging line, processes the containers 45 that are serially arranged on conveyor belt 40 which carries the containers from one station to the other of packaging line. FIG. 1 shows two (2) containers having received a sleeve of polymeric material as it will be described in further details hereinafter. One container is currently receiving a sleeve while two other containers are awaiting to be processed.

The sleeve 15 of polymeric material is dispensed from a supply reel 16 (schematically shown in the drawings) to the feeding assembly 10 which advances the sleeve along a feed path 70 (see FIG. 3) so the sleeve 15 is slipped over the neck 46 of the container 45 that is currently processed by the apparatus 5. In the illustrated form of the invention, the feeding assembly 10 comprises a downwardly extending generally cylindrical mandrel 55 stopping short from the neck portion 46 of the container 45. The material of choice for manufacturing the mandrel 55 is a low-friction polymer well known under the brand name "Nylon".

The top of the mandrel 55 is a conical portion 65 from which projects a thin guide plate 56. The plate 56 is inserted into a vertical slit 61 provided in the conical portion 65 and secured therein by means of adhesive or with mechanical fasteners. In a variant the plate 56 and the conical portion 65 can be made of a single piece. It will be apparent that the purpose of the guide plate 56 and the conical portion 65 is to progressively spread-out the flattened sleeve of polymeric material that is dispensed from the reel 16. As the sleeve advances over the mandrel 55, it acquires progressively a cylindrical shape so as to fit over the container cap.

Figure 2:
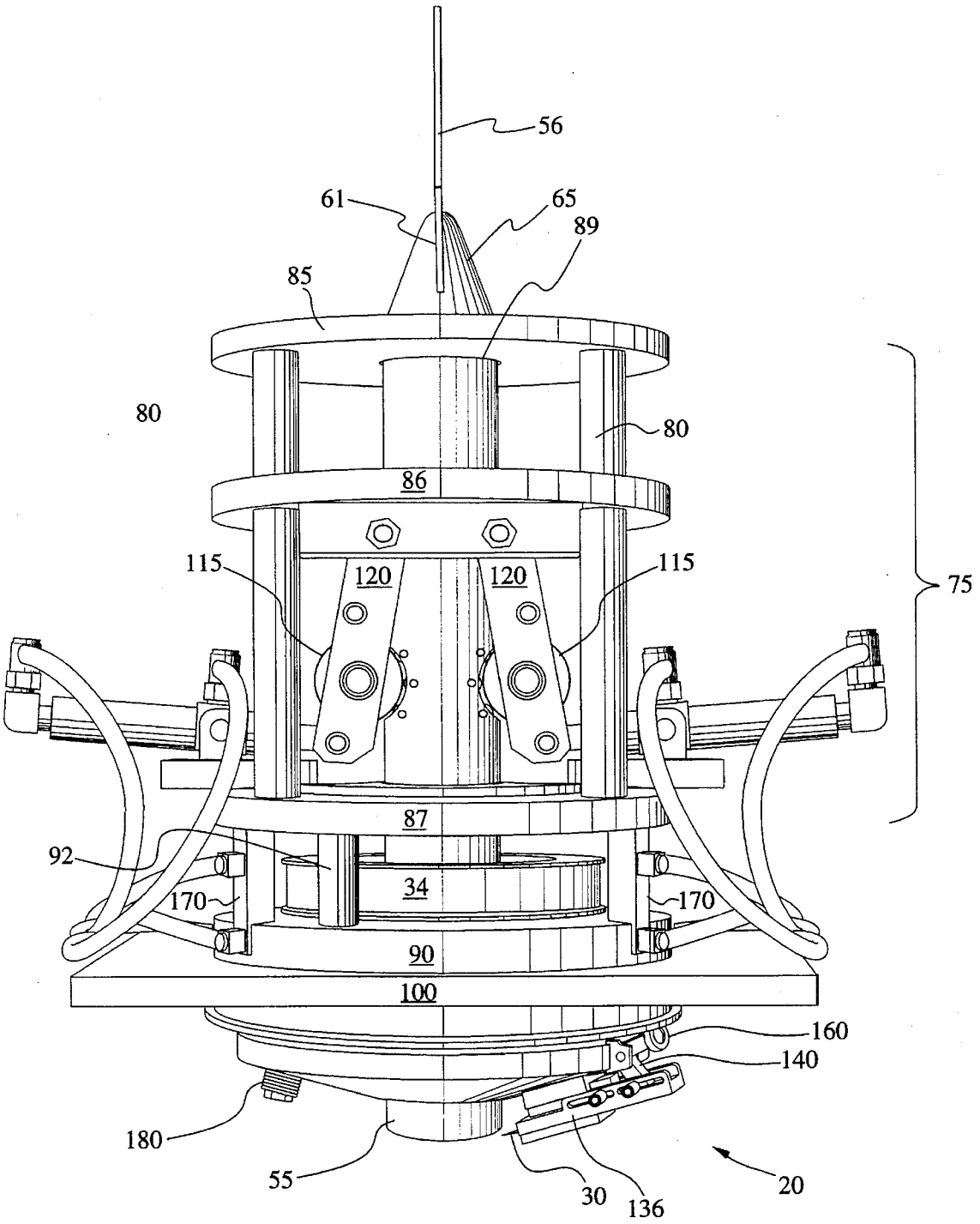
FIG. 2 is a front elevational view of the apparatus, the sleeve of polymeric material being omitted for clarity.

Now, with reference to FIGS. 1 and 2, the mandrel 55 is supported in a cage 75 including vertical frame members 80 interconnecting three coaxial and horizontally oriented rings 85, 86, 87 which are vertically spaced apart from one another. Each of the rings 85, 86, 87 defines a central bore 89 allowing the sleeve 15 to freely advance over the mandrel 55 along the feed path 70. The lower ring 87 is secured to a fourth ring 90 by the intermediary of an array of short connecting fingers 92. The ring 90 is also provided with a central bore to allow the sleeve 15 to pass therethrough. The ring 90 is in turn connected to a base plate 100.

Figure 3:
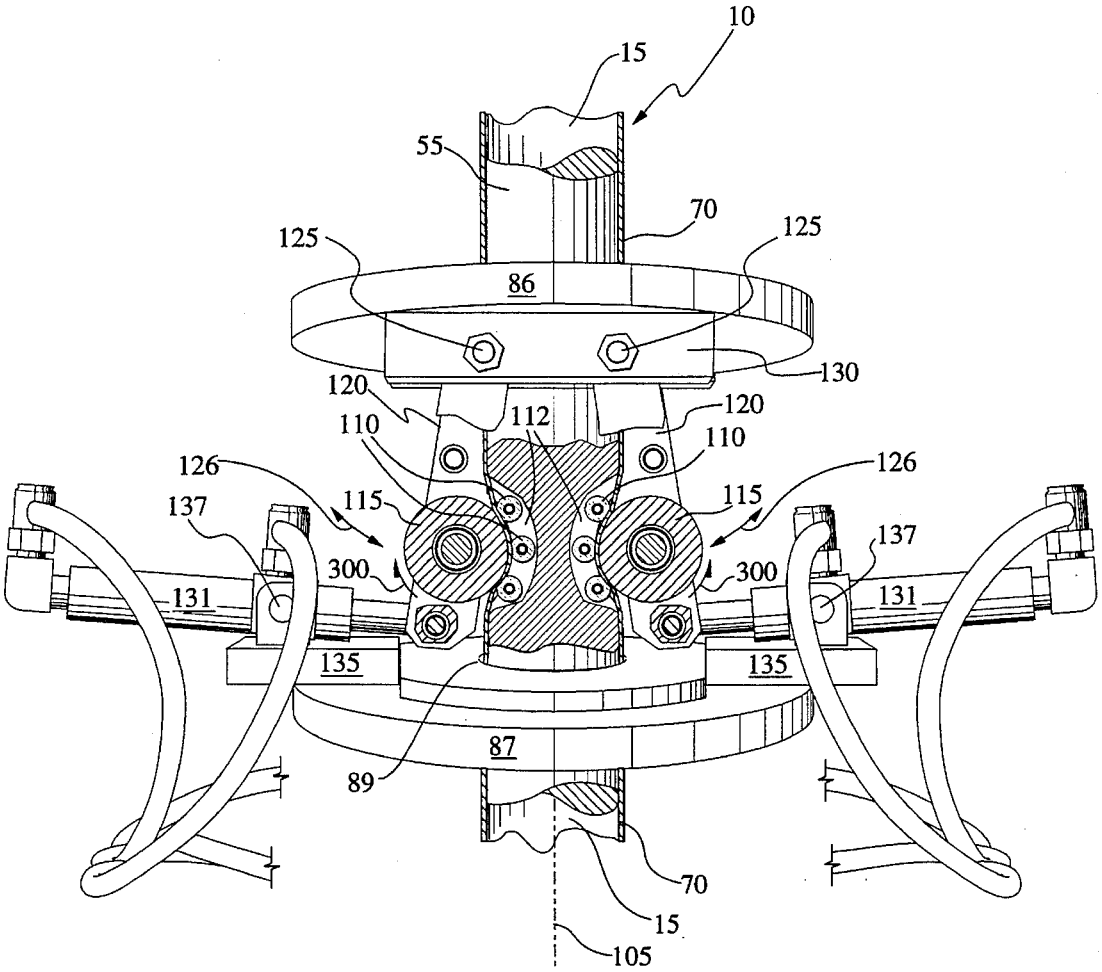
FIG. 3 is a vertical sectional view of a floating mandrel assembly of the apparatus shown in FIG. 1 for feeding the sleeve of polymeric material, also depicting a mechanism for advancing the sleeve of polymeric over the material.

As best shown in FIG. 3, the mandrel 55 of the sleeve feeding assembly 10 includes a pair of concave recesses 112 in which are mounted guide rollers 110. The latter cooperate with rollers 115 pivotally mounted on two pairs of elongated arms 120 (only one is shown in FIG. 3) in order to advance the sleeve over the mandrel 55, as will be described in greater detail hereinafter. The elongated arms 120 are rotatably mounted via axles 125 on mounting plate 130 (only one is shown in FIG. 3) secured to ring 86 by welding or any other appropriate means. This feature allows the elongated arms 120 and the rollers 115 to move with relation to the mandrel. The pivotal movement of the elongated arms 120 is effected by piston cylinder assemblies 131 of known construction.

By this arrangement, the rollers 115 vertically support the mandrel, allowing it to actually "float" in space without the necessity of any other supporting structure. When required to remove the mandrel 55 from the apparatus, it suffices to retract the piston cylinder assemblies 131 in order to remove the rollers 115 from the respective recesses 112 and thus free the mandrel from the apparatus. This operation is performed typically to set the apparatus for a new production run that requires a mandrel of different size.

The rollers 115 are caused to rotate in opposite directions by motors (not shown in the drawings) mounted to the arms 120. As seen by the arrows 300 in FIG. 3 the left hand roller 115 turns in the clockwise direction while the right hand roller 115 rotates in the counter clockwise direction. This rotary movement causes the sleeve of polymeric material to advance over the mandrel by virtue of the friction developed between the circumferential surface of the rollers 115 and the sleeve material.

Figure 4:
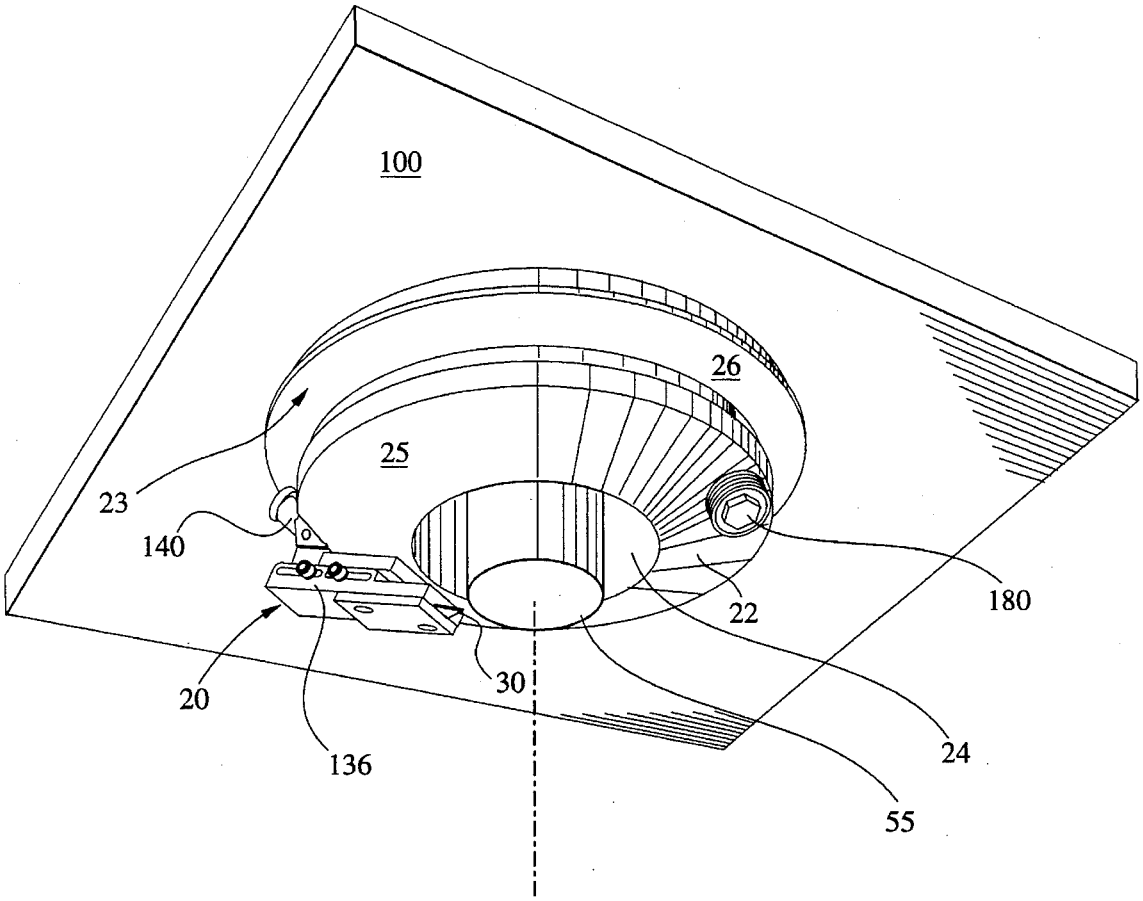
FIG. 4 is a perspective view from the bottom of the cutting assembly of the apparatus shown in FIG. 1.
Figure 5:
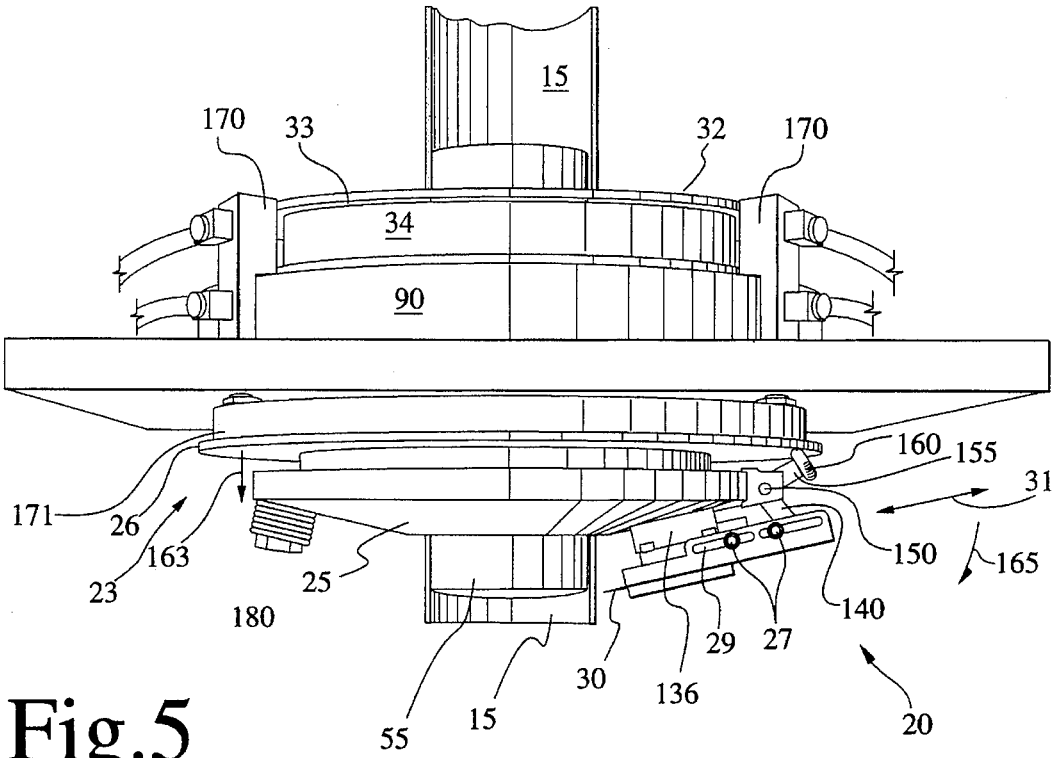
FIG. 5 is a front elevational view of the cutting assembly with the cutting blade in the non-cutting position.
Figure 6:
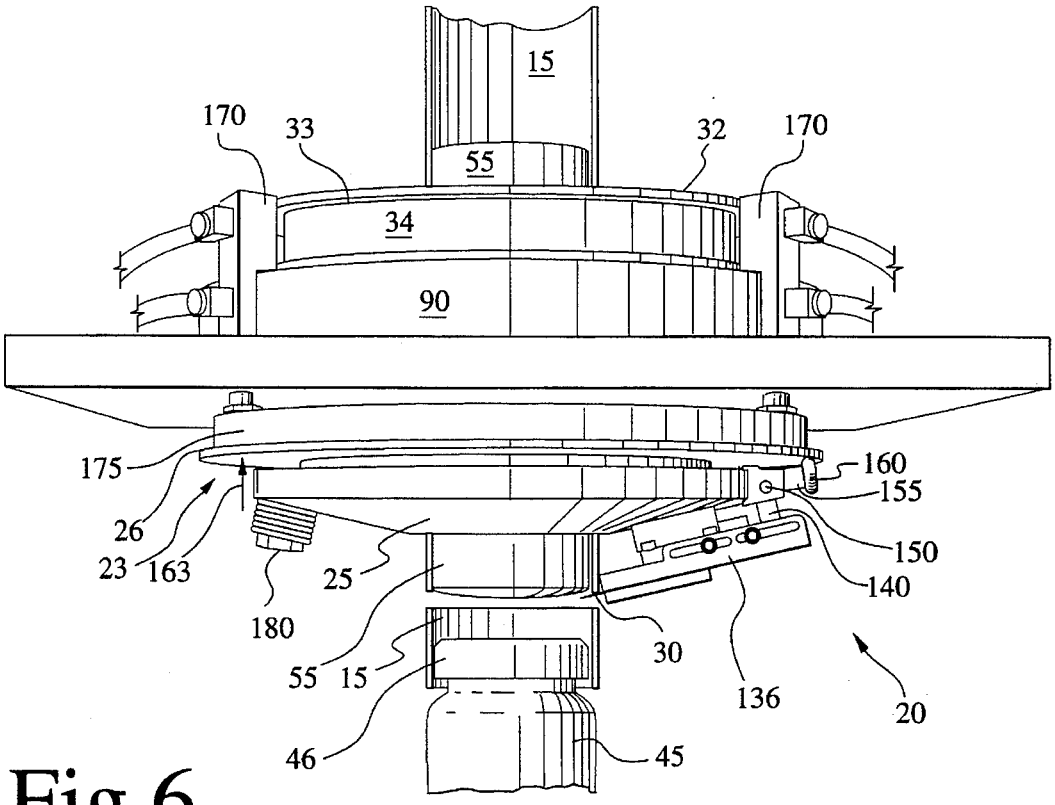
FIG. 6 is a front elevational view of the cutting assembly with the cutting blade in the cutting position.
Figure 7:
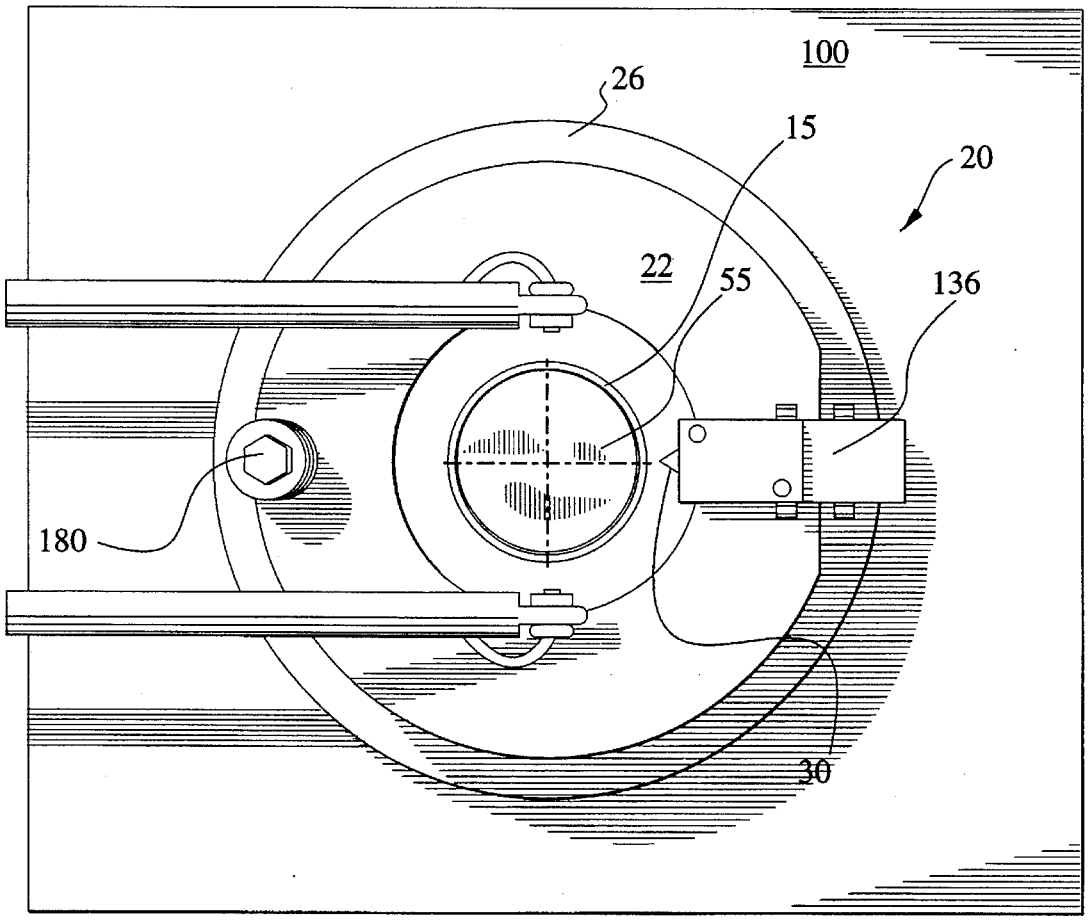
FIG. 7 is a bottom plan view of the apparatus of FIG. 1, shown With the cutting blade in the non-cutting position.

With reference to FIGS. 4, 5 and 6, the sleeve cutting assembly 20 is shown as comprising a blade carrier 25 rotatable about the feed path 70, a cutting blade 30 and a blade actuator assembly 23. In FIG. 4, the sleeve cutting assembly 20 is shown without the sleeve 15. The blade carrier 25 is in the form of a disk defining a central bore 24 allowing the sleeve 15 to freely advance over the mandrel 55 along the feed path 70. The blade actuator assembly 23 is a second disk 26 located above the blade carrier 25 providing an annular race which is engaged by an L-shaped mechanical lever 140 that extends the cutting blade 30 toward the cutting position (FIG. 6) when depressed. Cutting blade 30 is mounted to the blade carrier 25 and it is selectively moveable between a cutting position and a non-cutting position. In the cutting position (FIG. 5), the blade 30 penetrates the sleeve 15 whereby rotation of the blade carrier 25 about the feed path causes the blade to slit the sleeve 15. In the non-cutting position (FIG. 6), the blade 30 is in a spaced apart relationship with the sleeve 15, thereby allowing the sleeve 15 to advance along the feed path 70 without interfering with the cutting blade 30. The blade 30 which is in the form of a flat and thin metal plate having a pointed end and it is mounted to the blade carrier 25 in a housing 136. The blade can freely slide in the housing 136 so as to move from the non-cutting position to the cutting position and vice versa.

With reference to FIGS. 5 and 6, the blade actuator 23 includes the L-shaped mechanical lever 140 which is hinged at 150 to the blade carrier 25. A leg 155 of the L-shaped structure carries a roller 160 engaging the race on the disk 26 and the other leg is pivoted to the blade 30 sliding in the housing 136. It will be appreciated that the downward pivotal movement of the mechanical lever 140 about hinge 50 as shown by the arrow 165, causes the blade 30 to slide toward the sleeve 15 and thus acquire the cutting position.

As shown in FIGS. 5 and 6, the disk 26 of the blade actuator 23 is displaceable up and down as shown by the arrow 163 by means of piston cylinder assemblies 170 (partly shown). The disk 26 is shown in the upward position 171 in FIG. 5 and in the downward position 175 in FIG. 6. The downward movement (FIG. 6) of disk 26 forces the mechanical lever 140 to rotate clockwise, thus forcing the blade 30 to move in the cutting position. When the disk 26 is raised up by retracting the piston rods of the piston-cylinder assemblies 170, the pressure on the L-shaped mechanical lever 140 is released which causes the blade 30 to slide toward the non-cutting position under the influence of the centrifugal force generated by the rotation of the blade carrier. The movement of the blade 30 also causes the mechanical L-shaped lever 140 to pivot counterclockwise in order to resume its original position.

Disposed directly above the blade actuator 23 is a pulley 32 engaging a drive belt 34. The pulley 32 is hollow to clear a path for the sleeve 15 and it is secured in a co-axial relationship with the blade carrier 25. The drive belt 34 is coupled to a motor (not shown) for imparting rotation to the pulley 32 and thus to the blade carrier 25.

In use, the apparatus 5 continuously receives containers that are delivered on the conveyor belt and individually processes the containers to apply on their caps a band of heat-shrinkable material that is later on heated to form a tamper-proof seal. The application of the band of heat-shrinkable material involves two distinct operations, namely dispensing a length of sleeve 15 and cutting the sleeve 15 that remains on the container cap to form the seal.

The sleeve dispensing function is effected by rotating the rolls 115 over a predetermined angular interval that determines the amount of material dispensed during the feed cycle. A variety of arrangements can be used for rotating the rolls 115 stepwise, including stepper drive motors, a clutch arrangement, etc.

During the sleeve dispensing function the blade carrier 25 is continuously rotated about the feed axis 70, however, the cutting blade 30 is maintained in the non-cutting position so as to remain out of contact with the advancing sleeve. When the desired amount of material has been dispensed the cutting operation is effected by extending the piston-cylinder assemblies 170 downward in order to bring the disk 26 in proximity to the rotating blade carrier 25. As a result, the L-shaped mechanical lever 140 is pivoted clockwise (as seen in FIG. 5) which causes the blade 30 to slide toward the cutting position. During the entire duration of the engagement between the L-shaped mechanical lever 140 and the disk 26 the roller 160 rides on the annular race of the disk 26 so as to maintain the lever 140 in a depressed condition.

When the blade 30 is extended to the cutting position it penetrates into the sleeve of polymeric material and the rotation of the blade carrier 25 allows the cutting blade 30 to circumferentially slit the sleeve 15 until it is entirely severed. It will be appreciated that the cutting operation is effected in a progressive and well controlled manner which allows to reduce blade wear. When the cutting operation is completed, piston-cylinder assemblies 170 raise the disk 26 which relieves the pressure acting on the L-shaped mechanical lever 140. As a consequence, the cutting blade 30 slides back to the non-cutting position under the influence of the centrifugal force. The retraction movement of the cutting blade 30 also causes the L-shaped mechanical lever 140 to pivot upwardly.

To avoid vibrations while the blade carrier 25 is turning, it is preferred to provide the blade carrier 25 with a counterweight 180 which is placed in a position diametrally opposed to the housing 136.

The heat-shrinking of the sleeve portion that is applied to each container leaving the apparatus is effected by directing a jet of hot air at the containers to cause the sleeve to shrink and tightly engage the cap and the neck Of the container. The apparatus for producing a jet of hot air is not shown in the drawing because it does not form part of this invention.

It is to be understood that the various functions of the apparatus 5 such as the advancing and the cutting of the sleeve 15 are all effected in a timed relationship with the movement of the conveyor belt 40. At this end a plurality of sensors (not shown) are provided to supply information to an electronic controller (not shown) that regulates the operation of the apparatus.

In a variant, the apparatus 5 may be used for applying labels on the containers, rather than tamper proof seals. In this embodiment, the feeding assembly is programmed to dispense a longer sleeve section for each container which extends over the body of the container rather than being limited to the cap portion. The sleeve is then cut as described and heat-shrunk by the application of heat. It could also be envisaged to provide a device that would automatically slide down the band of polymeric material on the container, before it is heat shrunk, to locate it over the main body of the container below the neck portion. Such devices are commercially available and known to those skilled in the art.

While the form of the embodiment herein shown and described constitutes the presently preferred form, it is to be understood that other forms may be adapted falling within the scope of the following claims.

I claim:

1. An apparatus for applying a sleeve to a container, the apparatus comprising:

a) means for advancing the sleeve along a predetermined feed path for causing the sleeve to slip at least partially over the container;

b) a sleeve cutting assembly, including:

a blade carrier rotatable about said feed path;

a cutting blade mounted to said blade carrier, said cutting blade being selectively moveable between a cutting position and a non-cutting position, in said cutting position said blade penetrating the sleeve, whereby rotation of said blade carrier causes said blade to slit the sleeve, in said non-cutting position said blade being in a spaced apart relationship with the sleeve thereby allowing the sleeve to advance along said feed path without interfering with said cutting blade.

2. Apparatus as defined in claim 1, wherein said blade carrier includes a bore therethrough for allowing the sleeve to pass through said blade carrier.

3. Apparatus as defined in claim 2, wherein said blade carrier is disk-shaped.

4. Apparatus as defined in claim 1, comprising a blade actuator assembly for moving said blade between said cutting position and said non-cutting position, said blade actuator assembly including:

a race movable with relation to said blade carrier;

an actuating member mounted to said blade carrier and coupled to said cutting blade for moving said cutting blade toward said cutting position, said race extending along a path of travel of said actuating member during rotation of said blade carrier, whereby upon movement of said race toward said blade carrier said actuating member is displaced for causing a movement of said cutting blade to said cutting position, during a movement of said blade carrier about said feed axis said actuating member continuously engaging said race and maintaining said cutting blade in said cutting position.

5. Apparatus as defined in claim 4, wherein said actuating member includes a lever carrying a roller in rolling contact with said race when said lever is engaged by said race.

6. Apparatus as defined in claim 4, wherein said blade actuator assembly includes a disk-shaped member including an annular surface that provides said race.

7. Apparatus as defined in claim 5, wherein said race is movable with relation to said blade carrier along said feed axis.

8. Apparatus as defined in claim 7, comprising a piston-cylinder assembly coupled to said race for moving said race with relation to said blade carrier.

9. Apparatus as defined in claim 1, wherein said cutting blade is capable of moving toward said non-cutting position under the influence of centrifugal force.

10. An apparatus for applying a sleeve of shrinkable polymeric material over a container, said apparatus comprising:

a) feed means for advancing the sleeve of shrinkable polymeric material along a feed path for causing the sleeve to slip over a container;

b) a blade carrier member rotatable about said feed path, said blade carrier including a central bore through which the sleeve of shrinkable material can pass;

c) a cutting blade mounted to said blade carrier, said cutting blade is moveable between an extended position and a retracted position, in said extended position said butting blade engaging the sleeve of polymeric material, in said retracted position said cutting blade being in a spaced apart relationship with said sleeve of shrinkable polymeric material, whereby allowing the sleeve of shrinkable polymeric material to advance through said blade carrier without interfering with said cutting blade; and d) a blade actuating member mounted to said blade carrier, said actuating member being coupled to said cutting blade for moving said cutting blade toward said extended position in response to movement imparted to said blade actuating member.

11. An apparatus for applying a sleeve to a container, the apparatus comprising:

a) means for advancing the sleeve along a predetermined feed path for causing the sleeve to slip at least partially over the container;

b) a sleeve cutting assembly, including:

a blade carrier angularly movable about said feed path;

a cutting mounted to said blade carrier, said cutting blade being selectively moveable between a cutting position and a non-cutting position, in said cutting position said blade penetrating the sleeve, whereby angular movement of said blade carrier causes said blade to slit the sleeve, in said non-cutting position said blade being in a spaced apart relationship with the sleeve thereby allowing the sleeve to advance along said feed path without interfering with said cutting blade.

* * * * *